United States Patent [19]

Aasen et al.

[11] 4,343,891

[45] Aug. 10, 1982

[54] FIXING OF TETRA (HYDROCARBYL) BORATE SALT IMAGING SYSTEMS

[75] Inventors: Steven M. Aasen, Lakeland, Minn.; Rex J. Dalzell, Somerset, Wis.; Edward J. Goettert, Lake Elmo, Minn.; Brian N. Holmes, Oakdale, Minn.; George V. D. Tiers, St. Paul, Minn.

[73] Assignee: Minnesota Mining and Manufacturing Company, St. Paul, Minn.

[21] Appl. No.: 152,615

[22] Filed: May 23, 1980

[51] Int. Cl.[3] ..... G03C 5/24

[52] U.S. Cl. ..... 430/337; 430/339

[58] Field of Search ..... 430/337, 339

[56] References Cited

U.S. PATENT DOCUMENTS

| | | | |
|---|---|---|---|
| 3,567,453 | 3/1971 | Borden | 430/339 |
| 3,716,366 | 2/1973 | Riester | 430/338 |
| 3,754,921 | 8/1973 | Riester | 430/338 |

FOREIGN PATENT DOCUMENTS

| | | | |
|---|---|---|---|
| 1370058 | 10/1974 | United Kingdom | 430/339 |
| 1370059 | 10/1974 | United Kingdom | 430/339 |
| 1370060 | 10/1974 | United Kingdom | 430/339 |
| 1386269 | 3/1975 | United Kingdom | 430/339 |

OTHER PUBLICATIONS

Kazitsyna et al., "Synthesis, Structure, and Infrared Spectra of Aryldiazonium Halogenoborates and Tetraphenylborates" Izvestiya Akademii Nauk SSSR, No. 3, pp. 448–453, Mar. 1962.

*Primary Examiner*—Won H. Louie, Jr.

*Attorney, Agent, or Firm*—Cruzan Alexander; Donald M. Sell; Mark A. Litman

[57] ABSTRACT

A method for forming an image includes the step of desensitizing a radiation sensitive imaging system comprising a dye and a tetra (hydrocarbyl) borate in a binder by converting the tetra (hydrocarbyl) borate to a compound having fewer than four carbon-to-boron bonds.

26 Claims, No Drawings

FIXING OF TETRA (HYDROCARBYL) BORATE SALT IMAGING SYSTEMS

FIELD OF THE INVENTION

This invention relates to imaging processes and in particular to dye bleaching image forming systems. A light sensitive system comprising a dye and a tetra(hydrocarbyl)borate is shown to be capable of being rendered light-insensitive, i.e., fixed, after development.

BACKGROUND OF THE INVENTION

There exists a vast array of imaging systems having a multitude of various constructions and compositions. Amongst the more widely used systems are silver halide light sensitive systems (including black and white and color photography, dry silver photothermography, instant photography, and diffusion transfer systems, amongst others), photopolymeric systems (including planographic and relief printing plates, photoresist etching systems, and imaging transfer systems), diazonium color coupling systems, and others. Each system has its own properties attributable to the phenomenon which forms the basis of the imaging technology. For example, silver halide imaging systems are noted both for amplification (i.e., image densities which can be increased by further development without additional imagewise exposure) due to the catalytic action of silver towards the reduction of silver ion and for the fact that light sensitivity may be stopped after development by washing away the light sensitive silver halide salt (i.e., fixing). Photopolymeric systems are noted for image stability and ease of application of the imaging layer. Diazonium color coupling systems have high image resolution and are easy to coat onto supporting substrates.

One other type of imaging system which has received some attention in recent years uses a salt comprising an aromatic tetra(hydrocarbyl) borate anion as a dye-bleaching or solubility-altering photosensitive compound. U.S. Pat. No. 3,567,453 discloses the use of such borate salts (having at least one aryl substituent on the borate) in photoresist and lithographic compositions. U.S. Pat. No. 3,754,921 discloses an imaging system comprising a leucophthalocyanine and "phenylboronate". U.S. Pat. No. 3,716,366 even indicates that image stabilization might be achieved by reaction or dissolution and removal of one of the components (column 5, lines 1-8). British Pat. Nos. 1,370,058; 1,370,059; 1,370,060; and 1,986,269 also disclose dye bleaching processes using aromatic borates as light sensitive agents.

U.S. Pat. No. 3,716,366 suggests that desensitization may be effected by reactions with one of the components to form stable colorless products, and specifically suggests selectively dissolving out one of the components. No specific reagents or reaction mechanisms are suggested for the desensitization process, however.

SUMMARY OF THE INVENTION

It has been found that light sensitive imaging systems having a tetra(hydrocarbyl) borate as a light sensitive component thereof may be rendered light insensitive, particularly after imaging has been effected, by converting the borate to a product which does not have four carbon-to-boron bonds. The most useful borate containing light sensitive systems comprise a borate and a dye in a binder. Cationic dyes are particularly useful.

DETAILED DESCRIPTION OF THE INVENTION

Borates are variously referred to in the art as borates, boronates, boronides and by other chemical terms. In the practice of the present invention borates are strictly defined as tetra(hydrocarbyl)borates, that is, a compound having four carbon-to-boron bonds. These compounds may be represented by the formula:

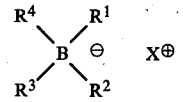

wherein $R^1$, $R^2$, $R^3$, and $R^4$ are independently any groups bonded to the boron from a carbon atom, and $X^{\oplus}$ is any cation except $H^{\oplus}$ and boron-carbon bond cleaving cations. The groups $R^1$, $R^2$, $R^3$, and $R^4$ may be independently selected from such groups as alkyl, aryl, alkaryl, allyl, arylalkyl, alkenyl, alkynyl, cyano, heterocyclic rings, alkyl-heterocyclic rings, etc. Any group bonded to the boron from a carbon atom is useful. When these substituents are referred to as groups, i.e., alkyl group versus alkyl, that nomenclature specifically is defined as allowing for substitution on the alkyl moiety (e.g., ether or thioether linkages in the alkyl chain, halogen, cyano, vinyl, acyloxy, or hydroxy substitution, etc.), remembering that the group must be bonded to the boron from a carbon atom. Thus, alkoxy and phenoxy would not be included. Cycloaliphatic groups are included in the definitions, as are heterocyclic groups bonded to the boron from a ring carbon atom or through an alkyl linkage (i.e., alkyl-heterocyclic). It is preferred that the R groups be selected from aryl (e.g., phenyl or naphthyl groups), alkyl (e.g., methyl, octyl, stearyl), alkenyl, alkynyl, allyl, and alkaryl (e.g., benzyl) groups. Preferably these groups contain no more than 20 carbon atoms. More preferably they contain no more than 12 carbon atoms and most preferably no more than 8 carbon atoms. Cyano is the least preferred aliphatic group.

The more preferred borates are those having at least three aliphatic groups bonded to the boron, and the most preferred borates have four aliphatic groups bonded to the boron.

Any cation may be used in association with the borate except for cations which break at least one carbon to boron bond on the borate, e.g., $H^+$. As a standard test, one could limit the cations to those which do not break at least one carbon to boron bond of tetraphenylborate. This can be readily determined by standard analytical techniques such as gas chromatography, infrared or mass spectrometry, nuclear magnetic reasonance, etc. It is highly preferred that the cations, if they are metal cations, be less readily reducible than ferric ions. Readily reducible metal ions are undesirable as they tend to fix or react with the borate. Organic cations are preferred. The nature of the cation has not been found to be critical in the practice of the present invention. The most significant contribution of the cation may be its effects upon solubility in different solvents or binders. The cations may range from simple elemental cations such as alkali metal cations (e.g., $Li^+$, $Na^+$. and K+) to complex cationic dyes and quaternary ammonium cations, e.g., such as represented by the formula:

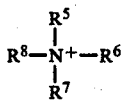

wherein $R^5$, $R^6$, $R^7$, and $R^8$ are independently selected from aliphatic (e.g., alkyl and particularly alkyl of 1 to 12 or preferably 1 to 4 carbon atoms), aryl (e.g., phenyl and naphthyl groups), and aralkyl (e.g., benzyl groups). For example, tetramethyl, tetraethyl, tetrapropyl, tetrabutyl and triethylmonomethyl ammonium are particularly useful. Cations such as phenyltrimethylammonium and benzyltriethylammonium are also quite satisfactory as are phosphoniums and sulfoniums. Quaternary cations in more complex forms such as quaternary dyes and quaternized groups in polymer chains are useful. The polymers, for example, could contain repeating groups such as:

a. 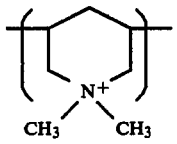

b. 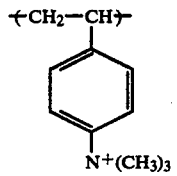

c. 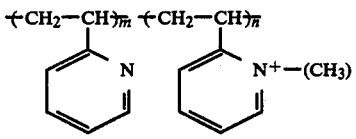

d. 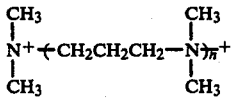

and e. 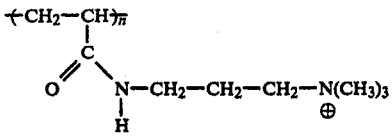

wherein m and n represent positive whole integers. With the proper selection of the quaternary ammonium cations, such polymeric materials could also serve as a binder for the system.

The dyes, for example, may be of any color and any chemical class. These dyes, of course, should not contain groups which would fix or densensitize the borate salts (e.g., carboxylic acid groups, sulfonic acid groups, metal ions more readily or as readily reducible than ferric ion). Any dye may be used in the practice of the present invention. Specific classes of dyes useful in the practice of the present invention include methines, triarylmethanes, cyanines, ketomethylenes, styryls, xanthines, azines, carbocyanines, butadienyls, azomethines, etc. The following are specific examples of dyes used in the practice of the present invention:

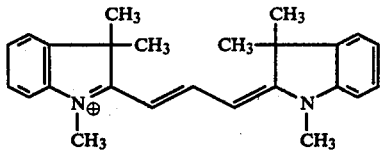

(magenta dye cation, Indolenine Red)

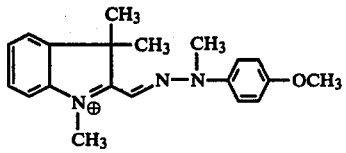

(yellow dye cation)

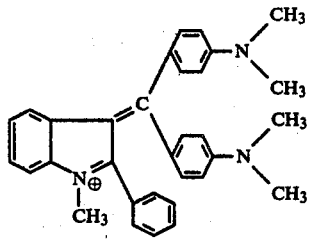

(cyan dye cation)

When cationic dyes have been used, a slight excess of borate anion is desired to provide complete bleaching.

The cationic dyes may have anions other than borates, such as the ionic dyes of the formula:

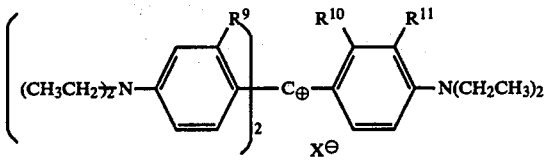

wherein $X^-$ is any anion including $Cl^-$, $I^-$, $Br^-$ perfluoro(4-ethylperfluorocyclohexane)sulfonate, sulfate, methyl sulfate, methanesulfonate, etc.

$R^9$ and $R^{10}$ are independently H, alkyl or alkoxy (preferably 1 to 12 carbon atoms and most preferably 1 to 4 carbon atoms), Cl, Br, and I, and $R^{11}$ is H or alkyl, preferably of 1 to 12 and most preferably 1 to 4 carbon atoms. Any cationic dye is useful in the practice of the present invention, and their listing is merely cumulative.

Imaging in the light sensitive systems comprising tetrahydrocarbyl borate, dye and binder is effected by irradiation. The radiation which is absorbed by the dye-borate system causes the dye to bleach. A positive image is thus produced. The use of cationic dyes is believed to spectrally sensitize the borates to radiation absorbed by the dyes associated with the borate. These are not sensitizing dyes as used in photographic imaging systems (usually in ratios of 1/500 or 1/10,000 of dye to light sensitive agents). These dyes are used in proportions of at least 1/10 to about 1/1 in ratio to the borates. Because the dye-borate system is spectrally sensitive, a multiplicity of colored dyes may be used (e.g., cyan, magenta, and yellow) in the same or different layers.

The binders useful in the present invention must be transparent or at least translucent. According to some practices of the present invention, the layers need not be penetrable by solvents or gases. Binders such as natural resins (e.g., gelatin, gum arabic, etc.), synthetic resins (e.g., polyacrylates, polyvinyl acetals, cellulose esters, polyamides, polycarbonates, polyolefins, polyurethanes, polyepoxides, polyoxyalkylenes, polyvinylhalides, polysiloxanes, polyvinylacetate, polyvinyl alcohol, etc.), and other media may be used. The binders may be thermoplastic or highly crosslinked.

The desensitization or fixing of the light sensitive tetrahydrocarbyl borates is effected by disrupting at least one of the carbon-to-boron bonds so that there are no longer four carbon-to-boron bonds in the compound. The compound may still have four bonds to the boron, but if at least one is no longer a carbon-to-boron bond, the resulting dye-borate system will not be usefully light sensitive and the resulting image will be stable. The conversion of the borates having four carbon-to-boron bonds to compounds having fewer than four carbon-to-boron bonds can be effected in a variety of fashions. Introducing an acid to reactive association with the tetrahydrocarbyl borate will effect such a conversion. This has been done for example, by subjecting the sheet to hydrochloric acid vapor, coating the sheet lightly with acetic acid, placing an acid containing polymeric sheet in temporary or permanent association with the imaging sheet and heating the composite, or including an acid-releasing light sensitive material in the sheet and irradiating the material (where it is sensitive to a different portion of the spectrum than the dye-borate system). The useful acids include for example, carboxylic acids (e.g., acetic acid, stearic acid, etc.), inorganic acids (e.g., nitric acid, sulfuric acid, hydrobromic acid, hydrochloric acid, sulfamic acid,), and organic acids other than carboxylic acids (e.g., aliphatic sulfonic and sulfonylic acids, fluorinated or perfluorinated carboxylic acids, etc.). Other materials which may be applied to the sheet in similar fashions include aldehydes (particularly by vapor treatment), peroxides, iodine, readily reducible metal ions, and quinones. These materials need only be introduced into reactive association with the tetra(hydrocarbyl) borate to effect fixing. Reactive association is defined as such physical proximity between materials as to enable a chemical reaction to take place between them.

The acids and acidic substances useful in the present invention as fixers generally have a $pK_a$ of less than 9, preferably a $pK_a$ of less than 7, and most preferably a $pK_a$ of less than 5, e.g., carboxylic acids, and halogenated or perfluorinated carboxylic acids such as acetic, citric and stearic acid, perfluorooctanoic acid, trifluoroacetic acid, dichloroacetic acid, and the like. Organic derivatives of inorganic acids are also quite useful, such as dioctylphosphoric acid, monobutylphosphoric acid, dodecylsulfuric acid, N-cyclohexylsulfamic acid and the like. Organic acids other than carboxylic acids such as aliphatic and aromatic sulfonic, sulfonylic and phosphonic acids such as bis(perfluoromethylsulfonyl)methane are useful. Protonated amine salts such as pyridine hydrochloride, imidazole trifluoroacetate, aniline methanesulfonate, and the like are suitable acidic substances, as are hydrazines and hydroxyl amine salts such as hydrazine bis-benzene sulfonate.

These and other aspects of the present invention may be seen in the following examples.

EXAMPLE 1

Indolenine Red (10 mgm) was coated out in a polyvinyl alcohol binder (5 g of a 7.5% by weight aqueous solution) with a molar excess of sodium tetraethylborate onto a polyester film backing in the dark. When the resulting film was inserted into the slide compartment of a commercial slide projector and irradiated, complete bleaching was achieved in less than one second, whereas when sodium tetraphenylborate was used, an irradiation time of over a minute is required. The system was fixed by coating it with a Polaroid ® print coater for black and white prints which contained acetic acid. Subsequent irradiation under the aforementioned conditions resulted in little or no dye bleaching. To date, a shelf life of three weeks has been attained with no noticeable loss of bleaching speed. Samples exposed through a dry silver fiche element using standard xenon flashlamps results in an exact reproduction of the fiche element. After fixing in a hydrochloric acid vapor, reader/printer blowback copies were made. Gray scale, resolution and reader/printer settings were equivalent to dry silver in all respects. The screen image on the reader/printer was an easily readable, brilliant magenta and produced excellent copies.

EXAMPLE 2

Samples of the dye tris(2-methyl-4-diethylaminophenyl)carbenium perfluoro(4-ethylcyclohexane) sulfonate (PECHS) were solution coated at saturated concentrations in a polyvinylacetate binder. The solvent used was a 3:1 (weight) solution of methylethylketone and toluene. The dye was cationic and a slight molecular excess of the active anion donor sodium tetraethylborate was incorporated into the solution. The air dried coating was stored in the dark and subsequently subjected to varying amounts of focused laser light having a wavelength of 6328 Å for several periods of time. Light power density was varied using neutral density filters. Exposure time was controlled by a mechanical shutter with electronic activation. Focused spot size was fixed. Recorded spot size was found to be a function of optical power density and exposure time. The dye-binder system was then fixed using the following methods: acid vapor exposure (acetic acid for two minutes) or, acid treated paper contact and heat (30 seconds, salicyclic acid, 95° C.). Samples were examined microscopically to determine spot size and photomicrographs were taken.

Laser power density was $2.037\times10^2$ watts/cm$^2$. Neutral density filters 1.0, 2.0, 3.0 and 4.0 were employed to reduce power. Exposure times used were $2/2^n$ where n=0, 1, 2, . . . 8. The following data were obtained:

TABLE 1

| N.D. Filter | Exposure (sec) | Spot Diameter (M) | Energy Density (nJ/m$^2$) |
|---|---|---|---|
| 2.0 | 0.0625 | 15.0 | 1.171 |
| 3.0 | 2.00 | 25.0 | 3.869 |
| 3.0 | 1.00 | 19.0 | 1.924 |

EXAMPLE 3

A mixture of Indolenine Red-PECHS (100 mg), tetraethylammonium tetrabutylborate (100 mg), and polymethylacrylate solution (10 ml of a 10% solids solution in 2-butanone:toluene, 3:1) was coated onto polyester ($1.02\times10^{-2}$ cm wet thickness) and the film was allowed to dry in the dark overnight.

A. Three samples of this film were imaged through a black target with a clear background on an overhead projector. The first imaged film was placed in a sealed jar above a solution of formaldehyde (50 ml of 37% solution neutralized to pH 8.5 with saturated $NaHCO_3$) for one hour in the dark. Subsequent irradiation by an overhead projector or by room light resulted in little or no dye bleaching.

B. The second imaged sample of this film was placed into a solution of formaldehyde (50 ml 37% formaldehyde, 2 ml methanol, 0.7 ml saturated $NaHCO_3$) for one hour in the dark. Subsequent irradiation by an overhead projector or by room light resulted in little or no dye bleaching.

C. The third imaged sample of this film was placed in a sealed jar above liquid benzaldehyde for one hour. This procedure fixed the image.

EXAMPLES 4–5

Coatings with various binders were prepared using a mixture of 100 mg of Crystal Violet F10B, 100 mg of $Et_4N^+ BBu_4^-$ and 10 ml of a binder (10% by weight) in MEK-Toluene (3:1). The mixtures were coated on polyester to $1.02\times10^{-2}$ cm wet thickness and dried in the dark. All films were imaged using an overhead projector through a positive transparency. The developed films were fixed by dipping them into a $CF_3CO_2H$ solution which contained 0.5% by weight of the acid in perfluoro(tributylamine), an inert fluorochemical solvent. The binders used and the length of time the films were in contact with the acid solution are tabulated. The fixing solution was maintained at room temperature. All films fixed and no further bleaching occurred on exposure to ambient light.

TABLE 2

| | Binder | Time (sec.) |
|---|---|---|
| a. | Elvacite® 2009 (a methyl methacrylate homopolymer having a viscosity (cP) in toluene at 37.5 wt percent at 25° C. of 1,700) | 10 |
| b. | Elvacite® 2041 (a methyl methacrylate homopolymer having a viscosity (cP) in toluene at 17.5 wt percent at 25° C. 1,400) | 15 |
| c. | Elvacite® 2042 (an ethyl methacrylate homopolymer having a viscosity (cP) in toluene at 37.5 wt percent at 25° C. 7,500) | 20 |
| d. | Elvacite® 2045 (a butyl methacrylate homopolymer having a viscosity (cP) in toluene at 30 wt percent at 25° C. of 3,600) | 20 |
| e. | Tyril® 789 (a styrene-acrylonitrile copolymer) | 20 |
| f. | Polymethylacrylate | 20 |

The same formulations were utilized with Indolenine Red-PECHS in polyvinylacetate, as well as with azomethine, cyanine, and styryl dyes with comparable results.

EXAMPLE 6

A mixture of Indolenine Red-PECHS (100 mg), tetraethylammonium tetrabutylborate (100 mg), and polymethylacrylate solution (10 ml of a 10% solids solution in 2-butanone:toluene 3:1) was coated onto polyester ($1.02\times10^{-2}$ cm wet thickness). The film was allowed to dry in the dark overnight.

A sample of this film was imaged through a mask on an overhead projector. The film was dipped in a 50% hydrogen peroxide solution for five minutes. The film was removed, washed with tap water and allowed to dry. At this time the image was fixed.

A second sample of the Indolenine Red-$Et_4NBBu_4$ film was imaged through a mask on an overhead projector. The film was dipped in a solution containing 1.0 g benzoyl peroxide, methanol (5 ml), and water (100 ml). The film was removed after 15 minutes in the fixing solution and the image was stabilized.

EXAMPLE 7

A mixture of Indolenine Red-PECHS (100 mg), tetraethylammonium tetrabutylborate (100 mg), and polymethylacrylate (10 ml of a 10% solids solution in MEK:Toluene, 3:1) was coated onto a polyester film backing ($1.016\times10^{-2}$ cm wet thickness) in the dark. The film was allowed to dry overnight. A sample of the dye-bleach film was imaged through a mask using an overhead projector as the exposure source. The film was placed in a jar containing a few crystals of iodine and the film was allowed to stand in the dark for 30 minutes. Subsequent irradiation by an overhead projector or room light resulted in little or no further bleaching.

EXAMPLE 8

Films of Indolenine Red PECHS (15 mg/ml of binder solution), and $Et_4NBBu_4$ (15 mg/ml of binder) in polyvinylacetate were prepared and dried in the dark. Three strips of film were imaged and dipped into the solutions listed below for five minutes. The images in all cases were found to be fixed, i.e., stable to light. Separate solutions (1% w:v) of p-benzoquinone, methylbenzoquinone, and chlorobenzoquinone in 20 ml water containing 0.5 ml MeOH were prepared.

EXAMPLES 9–15

These examples were performed in order to readily show how fixatives may be determined by NMR analysis to determine if a carbon to boron bond has been broken.

A 1% (w/v) solution of $Et_4NBEt_4$ was prepared in acetone-$d_6$ and ½ ml of this stock solution was weighed into each of 7 NMR tubes. Thus, each tube contained 0.02 mmol of $Et_4NBEt_4$. Various fixatives and non-fixatives were added to the NMR tubes (see Table I) and the NMR spectra were recorded after 3–4 hours at 25° C. and again after 7 hours at 50° C.

TABLE I

| Example | Additives | Wt. Additive | mmol Additive |
|---|---|---|---|
| 9 | $CH_3OH$ | 3.8 mg | 0.12 |
| 10 | $CF_3CH_2OH$ | 10.3 mg | 0.10 |
| 11 | $CH_3CO_2H$ | 8.4 mg | 0.14 |
| 12 | benzoquinone | 17.2 mg | 0.11 |
| 13 | $(CH_3)_2CO.3/2\ H_2O$ | 13.3 mg | 0.14 |
| 14 | 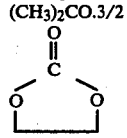 | 9.7 mg | 0.11 |
| 15 | none | 0 | 0 |

The $\overline{B}Et/\overline{N}Et$ ratio was determined for each NMR spectrum and the results are recorded in Table II.

TABLE II

| Example | Additive | Treatment | $\bar{B}Et/\overset{+}{N}Et$ | Fix-ative |
|---|---|---|---|---|
| 9 | $CH_3OH$ | 25°/3–4 hr. | 0.92 | No |
| | | 50°/7 hr. | 0.93 | |
| 10 | $CF_3CH_2OH$ | 25°/3–4 hr. | 0 | Yes |
| | | 50°/7 hr. | 0 | |

| Tube # | Additive | Treatment | $\bar{B}Et/\overset{+}{N}Et$ | Fix-ative |
|---|---|---|---|---|
| 11 | $CH_3CO_2H$ | 25°/3–4 hr. | 0.81 | Yes |
| | | 50°/7 hr. | 0.32 | |
| 12 | benzoquinone | 25°/3–4 hr. | 0 | Yes |
| | | 50°/7 hr. | 0 | |
| 13 | $(CF_3)_2CO.3/2\ H_2O$ | 25°/3–4 hr. | 0.95 | Yes |
| | | 50°/7 hr. | 0.49 | |
| 14 | 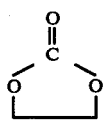 | 25°/3–4 hr. | 0.96 | No |
| | | 50°/7 hr. | 0.92 | |
| 15 | none | 25°/3–4 hr. | 0.96 | No |
| | | 50°/7 hr. | 0.93 | |

The ratio of $\bar{B}Et_4/\overset{+}{N}Et_4$ was determined from the ratio of the peak area representing the methylene group of $\bar{B}(C\underline{H}_2CH_3)_4$ relative to that for the methyl group of $\overset{+}{N}(CH_2C\underline{H}_3)_4$. In the experiments where there was a large decrease in the $\bar{B}Et_4/\overset{+}{N}Et_4$ ratio (e.g., $CH_3CO_2H$, $(CF_3)_2CO.3/2H_2O$ and benzoquinone), there was concurrent formation of new peaks in the spectra. These new peaks may be resulting from the formation of new $—OCH_2CH_3$ linkages or from the formation of $BEt_3$.

EXAMPLE 17

The following solution was knife coated in the dark at $1.3\times10^{-2}$ cm wet thickness on a matt paper substrate.

5.0 g polyvinyl acetate (10% solids in methylethylketone and toluene, 3:1 by weight)
25.0 mg diphenyliodonium tetraphenylborate
28.0 mg allyl triphenyl phosphonium tetraphenylborate
14.0 mg cyan dye
5.0 mg yellow dye

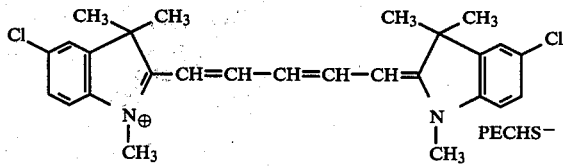

2.0 mg magenta dye

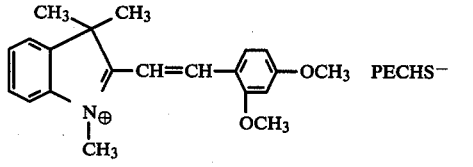

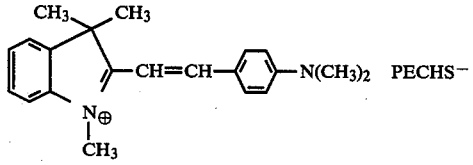

After drying in the dark, the sample was exposed in a 500 watt slide projector through (and in contact with) a 35 mm color positive slide for two minutes. A positive full color reproduction of the original slide resulted.

Fixation was accomplished by soaking five minutes in the following solution:

| | |
|---|---|
| 250 ml | 5 parts water<br>1 part methanol |
| 37.5 g | phosphotungstic acid |

The fixed sample was washed five minutes in water to remove any excess acid and allowed to dry. Following fixing, the resulting full color print was exposed to ambient light for several weeks without showing any deterioration in quality.

EXAMPLE 18

A mixture of polyvinyl acetate (10% solids in methylethylketone and toluene, 3:1 by weight), the magenta dye

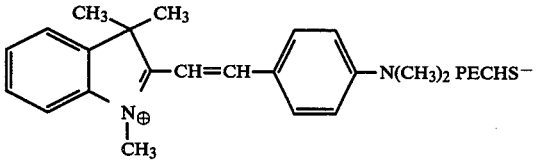

(an amount sufficient to give an optical density of 1.0 upon coating and reading with a Kodak status A green filter), and a molar excess of sodium tetraphenyl borate (with respect to the dye), was knife coated in the dark at $7.6\times10^{-3}$ cm wet thickness and air dried in the dark. The resulting photosensitive film was exposed through a positive original using a 500 watt projector to give a position image. Different samples were fixed by the following procedures:

(a) 2 minute exposure to hydrochloric acid vapor
(b) 2 minute exposure to trifluoroacetate acid vapor
(c) 2 minute exposure to dichloroacetic acid vapor
(d) wiping the surface of the imaged sample with a solution of dichloroacetic acid in heptane.

Each of the methods of fixing yielded a stable positive reproduction of the original.

EXAMPLE 19

A mixture of 5 g fully hydrolyzed polyvinyl alcohol (10% solids in water) and 50 mg citric acid was knife coated on $7.6\times10^{-3}$ cm polyester at $5.1\times10^{-3}$ cm wet thickness and air dried.

A second solution containing 5 g of a vinyl acetate/-dibutyl maleate copolymer (81% vinyl acetate, 19% dibutylmaleate, as 20% solids in methylethylketone and toluene, 1:1 by weight), 10 mg magenta dye

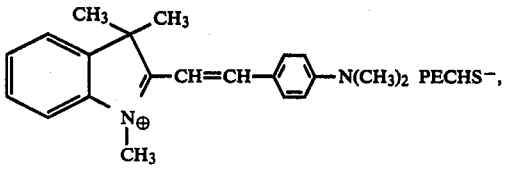

13 mg cyan dye

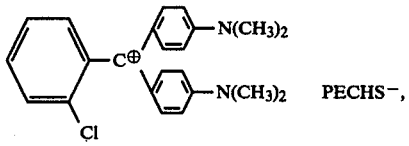

25 mg yellow dye

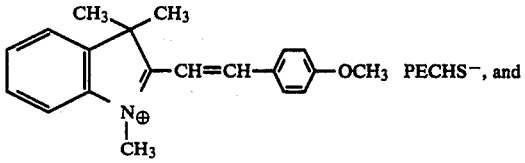

60 mg sodium tetraphenyl borate was knife coated in the dark on top of th polyvinyl alcohol-acid containing coating and air dried in the dark.

While the sample was heated to 75° C., a projected color positive image was focused (using a 500 watt slide projector at approximately two feet distance) on the sample. A full color transparency was obtained after ten minutes.

The imaged sample was fixed by heating on a heat blanket at 150° C. for 15 seconds and the resulting copy was rendered stable to ambient light.

EXAMPLE 20

Four coatings, each containing a different bleach agent but otherwise being the same, were imaged and subsequently fixed with an exposure to hydrochloric acid vapor for 3½ minutes.

Formulation of the four coatings were as follows:

10 ml polyvinyl acetate (15% solids in methylethylketone and toluene, 1:1 by weight)

100 mg Indolenine Red+ PECHS−, i.e.,

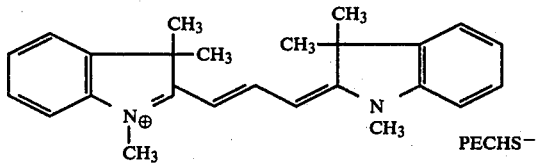

(all four coatings)

plus bleach agent:

Coating #1: 90.44 mg $Et_4NBBu_4$

Coating #2: 95.34 mg $Et_4NBBu_3Phenyl$

Coating #3: 100.5 mg $Et_4NBBuPhenyl_3$

Coating #4: 83.8 mg $NaB(Phenyl)_4$

The nomenclature for the bleach agents lists the cation first (e.g., $Et_4N$) and then the anion (e.g., $BBu_4$).

EXAMPLE 21

A mixture of 10 mg of the cyan dye

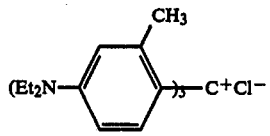

5 g polyvinyl acetate (10% solids in methylethylketone and toluene, 1:1 by weight), and a molar excess (with respect to the dye) of sodium tetraethyl borate was knife coated at $7.6\times10^{-3}$ cm wet thickness on polyester and air dried in the dark.

A top coating of 3 g Plaskon® alkyd-vinyl toluene copolymer, 25% solids in VM & P naphtha sold by Amsco Division, Union Oil Company of California, Minneapolis, MN 55414) and 100 mg tetrachlorophthalic acid mono(3,6-dioxa-n-dodecyl)ester was made at $5.1\times10^{-3}$ cm wet thickness. The sample was imaged through a black and white original transparency on an overhead projector for 2 seconds resulting in a positive cyan colored image with a clear background. The imaged sample was fixed by heating on a heat blanket for 15 seconds at 90° C.

EXAMPLE 22

An amount of Indolenine Red+ PECHS− dye sufficient to give an optical density (at a film thickness of $1.2\times10^{-2}$ cm) of 1.0 when read with a Kodak status A green filter and a molar excess of sodium tetraethyl borate with respect to the dye, were added to polyvinyl acetate (10% solids in methylethylketone and toluene, 1:1 by weight).

The following, when added to the above solution in a molar excess amount with respect to the sodium tetraethyl borate, give fixation after a 10–30 second exposure to a hand-held lamp emitting long wavelength ultraviolet light:

(a) methyl-bis-(trichloromethyl)-s-triazine, (b) 3-amino-4-chloro benzophenone-2-carboxylic acid, and

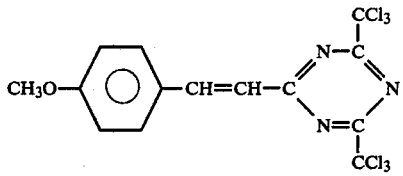

(c)

Imagewise exposure to the UV source, followed by subsequent intense visible light exposure yields negative rather than positive images.

EXAMPLES 23–58

The following examples show the general utility of fixing agents exhibiting a $pk_a$ of less than about 9 when measured in aqueous 65 weight percent ethanol at 25°, according to the method of E. Grunwald et al., J. Am. Chem. Soc. 73, 4939 (1951), and 75, 559 (1953), incorporated herein by reference. The fixing agents, all of which have a $pk_a$ of less than 9, were dissolved in ethanol or 65% ethanol and applied to the film of Example 8 which was then exposed to light. Fixation was observed at 25° in Examples 23 to 37, while heating of the treated film to 105° was required to achieve prompt fixation in Examples 38 to 46. The materials used in the examples were: (23) aniline hydrochloride, (24) N-cyclohexylsulfamic acid, (25) pyridine hydrochloride, (26) butyl acid phosphate, (27) diethyl phosphate, (28) dodecylbenzenesulfonic acid, (29) phenylphosphinic acid, (30) phenylphosphonic acid, (31) diethyl phosphate, (32) ammonium dodecyl sulfate, (33) N-methylmorpholinium 2-ethylhexanoate, (34) isopropanolammonium 2-ethylhexanesulfonate, (35) N,N-dimethyl dodecylammonium 2-ethylhexanoate, (36) N-methylethanolammonium 2-ethylhexanoate, (37) N,N-dimethyldodecylammonium N-cyclohexyl sulfamate, (38) N-methylmorpholinium p-toluenesulfonate, (39) phenylalanine hexyl ester hydrochloride, (40) ethylenediamine bis-p-toluenesulfonate, (41) p-chlorobenzohydroxamic acid, (42) morpholinium p-toluenesulfonate, (43) piperidinium p-toluenesulfonate, (44) tribenzylammonium p-toluenesulfonate, (45) tribenzylammonium mono-n-hexoxyethoxyethyl tetrachlorophthalate, and (46) N,N-dimethyl dodecylammonium p-toluenesulfonate.

Further examples of fixing agents are: (47) hydrazinium perfluorooctane sulfonate, (48) ascorbic acid, (49) hydroxylammonium trifluoromethanesulfonate, (50) benzoic acid, (51) ethanolamine oleate, (52) adipic acid, (53) crotonic acid, (54) cyanoacetic acid, (55) pentachlorophenol, (56) lactic acid, (57) saccharin, and (58) thiophenol.

What is claimed is:

1. A method for desensitizing a radiation sensitive imaging system comprising a dye and a tetra(hydrocarbyl)borate in a binder which method comprises converting the tetra(hydrocarbyl)borate to a compound having fewer than four carbon-to-boron bonds after said radiation sensitive imaging system has been image-wise exposed to radiation, said converting being effected by introducing into reactive association with said borate a material selected from the group consisting of acids, aldehydes, peroxides, quinones, iodine or readily reducible metal ions.

2. A method for forming an image which includes the step of desensitizing a radiation sensitive imaging system comprising a dye and a a tetra(hydrocarbyl)borate in a binder, which method comprises converting the tetra(hydrocarbyl)borate to a compound having fewer than four carbon-to-boron bonds.

3. A method for desensitizing a radiation sensitive imaging system comprising a dye and a tetra(hydrocarbyl)borate in a binder which method comprises converting the tetra(hydrocarbyl)borate to a compound having fewer than four carbon-to-boron bonds after said radiation sensitive imaging system has been image-wise exposed to radiation.

4. The method of claim 1 wherein said conversion is effected by introducing an acid into reactive association with said tetra(hydrocarbyl)borate.

5. The method of claim 4 wherein said acid is selected from the group consisting of inorganic acids, carboxylic acids, aliphatic sulfonic acids, aliphatic sulfonylic acids, and fluorinated carboxylic acids.

6. The method of claim 1 wherein said conversion is effected by introducing an aldehyde into reactive association with said tetra(hydrocarbyl)borate.

7. The method of claim 1 wherein said conversion is effected by introducing a peroxide into reactive association with said tetra(hydrocarbyl)borate.

8. The method of claim 1 wherein said conversion is effected by introducing a quinone into reactive association with said tetra(hydrocarbyl)borate.

9. The method of claim 1 wherein said conversion is effected by introducing iodine into reactive association with said tetra(hydrocarbyl)borate.

10. The method of claim 1 wherein said conversion is effected by introducing readily reducible metal ions into reactive association with said tetra(hydrocarbyl)borate.

11. The method of claims 1 wherein said tetra(hydrocarbyl)borate is associated with a cationic dye.

12. The method of claims 3, 4, 5, 6, 7, 8, 10, 2 or 1 wherein said tetra(hydrocarbyl)borate has the structural formula:

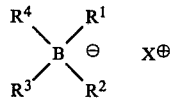

wherein $R^1$, $R^2$, $R^3$ and $R^4$ are independently groups bonded to the boron from carbon atoms, and $X^+$ is any cation except those which break at least one carbon to boron bond of the borate.

13. The method of claim 11 wherein said tetra(hydrocarbyl)borate has the formula:

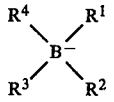

wherein $R^1$, $R^2$, $R^3$ and $R^4$ are independently selected from groups bonded to the boron from carbon atoms, $X^+$ is any cation except those which break at least one carbon-to-boron bond of the borate, and said desensitizing is performed after said radiation sensitive imaging system has been image-wise exposed to radiation to which said imaging system is sensitive.

14. The method of claim 12 wherein $R^1$, $R^2$, $R^3$ and $R^4$ are independently selected from the group consisting of alkyl groups, aryl groups, alkaryl groups, arylalkyl groups, alkenyl groups, alkynyl groups, cyano, heterocyclic groups, and alkyl-heterocyclic groups.

15. The method of claim 13 wherein $R^1$, $R^2$, $R^3$ and $R^4$ are independently selected from the group consisting of alkyl groups, aryl groups, alkaryl groups, arylalkyl groups, alkenyl groups, alkynyl groups, cyano, heterocyclic groups, and alkyl-heterocyclic groups.

16. The method of claim 14 wherein $R^1$, $R^2$, $R^3$ and $R^4$ have no more than 20 carbon atoms each.

17. The method of claim 15 wherein $R^1$, $R^2$, $R^3$ and $R^4$ have no more than 20 carbon atoms each.

18. The method of claim 16 wherein $X^+$ is a cationic dye.

19. The method of claim 17 wherein $X^+$ is a cationic dye.

20. The method of claims 13, 14, 15, 16, 17, 18 or 19 wherein $R^1$, $R^2$, $R^3$, and $R^4$ are selected from the group consisting of alkyl and allyl groups.

21. The method of claims 3, 15, 16, 17, 18, or 19 wherein said dye is selected from the class consisting of methines, triarylmethanes, cyanines, ketomethylenes, styryls, xanthines, azines, carbocyanines, butadienyls, and azomethines and the hydrocarbyl groups on said borate are selected from alkyl and allyl groups.

22. The method of claim 2 wherein said tetra(hydrocarbyl)borate is associated with a cationic dye.

23. The method of claim 22 wherein said tetra(hydrocarbyl)borate has the formula:

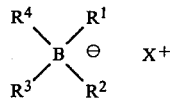

wherein $R^1$, $R^2$, $R^3$ and $R^4$ are independently selected from groups bonded to the boron from carbon atoms, and $X^+$ is any cation except those which break at least one carbon-to-boron bond of the borate.

24. The method of claim 23 wherein $R^1$, $R^2$, $R^3$ and $R^4$ are independently selected from the group consisting of alkyl groups, aryl groups, alkaryl groups, arylalkyl groups, alkenyl groups, alkynyl groups, cyano, heterocyclic groups and alkyl-heterocyclic groups.

25. The method of claim 24 wherein $R^1$, $R^2$, $R^3$ and $R^4$ have no more than 20 carbon atoms each.

26. The method of claims 23 and 25 wherein $R^1$, $R^2$, $R^3$ and $R^4$ are selected from the group consisting of alkyl and alkyl groups.

* * * * *